US006098556A

United States Patent [19]

Harel et al.

[11] Patent Number: 6,098,556

[45] Date of Patent: Aug. 8, 2000

[54] APPARATUS FOR ALTERING LENGTH OF TROUSERS

[75] Inventors: Dan Harel, Rishon le Zion; Ilan Lamerovitch, Jerusalem, both of Israel

[73] Assignee: Createch Ltd., Ramat Gan, Israel

[21] Appl. No.: 09/024,039

[22] Filed: Feb. 16, 1998

[30] Foreign Application Priority Data

Jun. 2, 1998 [IL] Israel ..... 123205

[51] Int. Cl.[7] ..... D05B 19/12; D05B 21/00

[52] U.S. Cl. ..... 112/470.04; 112/470.05; 112/470.16; 112/475.13; 112/470.06

[58] Field of Search ..... 112/470.05, 470.04, 112/470.06, 470.07, 470.13, 470.14, 470.16, 475.06, 475.04, 475.13, 130, 147; 700/132; 83/76.9, 76.1; 364/470.01, 470.05, 470.07, 470.08, 470.09

[56] References Cited

U.S. PATENT DOCUMENTS

| | | | |
|---|---|---|---|
| 4,149,246 | 4/1979 | Goldman | 700/132 |
| 4,341,169 | 7/1982 | Mainot et al. | 112/68 X |
| 4,653,122 | 3/1987 | Zanoni . | |
| 4,916,624 | 4/1990 | Collins et al. . | |
| 4,916,634 | 4/1990 | Collins et al. . | |
| 4,926,344 | 5/1990 | Collins et al. . | |
| 4,957,054 | 9/1990 | Sakuma et al. | 112/470.13 |
| 5,163,007 | 11/1992 | Slilaty . | |
| 5,233,534 | 8/1993 | Osthus et al. . | |
| 5,383,410 | 1/1995 | Mukai et al. . | |
| 5,816,177 | 10/1998 | Brocklehurst | 112/470.05 |

*Primary Examiner*—Peter Nerbun
*Attorney, Agent, or Firm*—Akin, Gump, Strauss, Hauer & Feld, L.L.P.

[57] ABSTRACT

Apparatus for altering length of trousers, including a controller including an input device for inputting customer-dictated parameters for altering a leg of a pair of trousers after manufacture thereof, and a cutting head in electrical communication with the controller which receives the parameters and cuts the leg to a desired length in accordance with at least one of the parameters. A method for altering length of trousers is also disclosed which additionally includes performing a finishing operation on the cut trousers. The performing preferably includes inputting a position of a fold line for forming a hem and inputting sewing instructions into the input device, folding the trousers to form the hem, and sewing the hem according to the sewing instructions.

18 Claims, 7 Drawing Sheets

APPARATUS FOR ALTERING LENGTH OF TROUSERS

FIELD OF THE INVENTION

The present invention relates generally to apparatus for altering length of trousers.

BACKGROUND OF THE INVENTION

Automated devices related to construction of trousers or similar garments are known in the art. The following U.S. Patents are believed to be representative of the art:

U.S. Pat. No. 4,653,122 to Zanoni describes a method for automated construction of pants. U.S. Pat. Nos. 4,916,624, 4,916,634 and 4,926,344, all to Collins et al., relate to a system for preparing garment pattern data to enable computer prealteration. U.S. Pat. No. 5,163,007 to Slilaty describes a system for measuring custom garments. Data pertaining to the measurements of a person to be fitted are entered into a computer along with clothing style preferences. U.S. Pat. No. 5,233,534 to Osthus et al. relates to a production system for garments. U.S. Pat. No. 5,383,410 to Mukai describes an automatic hemming apparatus for supplying a tubular workpiece in a desired attitude to a sewing machine. U.S. Pat. No. 5,513,590 to Allison et al. describes an automatic trousers indexing method and an apparatus for belt loop attachment with improved tension control and seam detection.

However, none of the prior art is applicable for solving a simple problem confronted by many purchasers of trousers: too often the trousers in a clothing store are too long and length adjustment requires taking the pants to a tailor, requiring extra time and expense. None of the prior art discloses simple apparatus or methods for automatically and quickly adjusting length of trousers, suitable for implementation in a store setting.

SUMMARY OF THE INVENTION

The present invention seeks to provide an improved apparatus and method for automatically and quickly adjusting length of trousers. The process includes marking and setting a desired length of a leg of the trousers, cutting the trousers to the desired length, folding a hem, and sewing the hem according to desired parameters set in a user's interface. The apparatus includes panels which lock the trousers legs, a folding mechanism, sewing heads and a cutting head, and an adjusting device which moves the panels into alignment with the sewing and cutting heads, all of which are automatically controlled and coordinated. The apparatus and method of the present invention are designed for convenient implementation in a store setting.

It is noted that throughout the specification and claims the term "trousers" encompasses any garment shaped to cover a limb of a body with individual, tubular covering portions, such as pants, shorts, dungarees, jeans, gauchos, knickers, pajamas, culottes, slacks and the like, and also a shirt with sleeves, and the like.

There is thus provided in accordance with a preferred embodiment of the present invention apparatus for altering length of trousers, including a controller including an input device for inputting customer-dictated parameters for altering a leg of a pair of trousers after manufacture thereof, and a cutting head in electrical communication with the controller which receives the parameters and cuts the leg to a desired length in accordance with at least one of the parameters.

In accordance with a preferred embodiment of the present invention there is also provided finishing apparatus in electrical communication with the controller for performing a finishing operation on the cut trousers in accordance with instructions received from the controller.

Further in accordance with a preferred embodiment of the present invention there is provided a trousers gripping device for fixedly holding the leg of the trousers to permit performing a trousers alteration operation on the leg, the trousers gripping device being in electrical communication with the controller.

Still further in accordance with a preferred embodiment of the present invention there is provided at least one sewing head in electrical communication with the controller, the sewing head sewing the leg of the trousers, after cutting thereof, in accordance with instructions received from the controller.

Additionally in accordance with a preferred embodiment of the present invention there is provided a folding mechanism, in electrical communication with the controller, for folding the leg of the trousers in accordance with instructions received from the controller.

In accordance with a preferred embodiment of the present invention the trousers gripping device includes a pair of main panels arranged for clamping the leg therebetween, each main panel including a channel which receives therein a secondary panel, the secondary panel sliding in the channel and selectively protruding from the main panel in accordance with instructions received from the controller.

Further in accordance with a preferred embodiment of the present invention the secondary panel includes a folding mechanism, in electrical communication with the controller, for folding the leg of the trousers in accordance with instructions received from the controller.

Still further in accordance with a preferred embodiment of the present invention the folding mechanism includes at least one wire pivotally attached to an end of the secondary panel, the at least one wire being arranged to swing against the leg, thereby to fold a portion of the leg about the end of the secondary panel.

Additionally in accordance with a preferred embodiment of the present invention a pair of scissors arms is each connected at one end thereof to each main panel, each scissors arm being threadedly attached at an opposite end thereof to a threaded rod, one portion of the rod having a right-handed thread and connected to one of the scissors arms and another portion of the rod having a left-handed thread and connected to the other one of the scissors arms, the right-handed threaded portion adjoining the left-handed threaded portion at a central portion, the rod being connected to a motor for rotation thereof, such that rotation in a first direction of the rod causes both the scissors arms to advance towards each other and towards the central portion, thereby at the same time causing the main panel to move generally radially and linearly away from the rod, and wherein rotation in a second direction, opposite to the first direction, of the rod causes both the scissors arms to advance away from each other and away from the central portion, thereby at the same time causing the main panel to move generally radially and linearly towards the rod.

In accordance with a preferred embodiment of the present invention the trousers gripping device includes a plurality of the pairs of main panels arranged for clamping the leg therebetween, the plurality of pairs being generally symmetrically arranged about a shaft.

Further in accordance with a preferred embodiment of the present invention the trousers gripping device includes a plurality of the pairs of main panels arranged for clamping the leg therebetween, the plurality of pairs being generally symmetrically arranged about a shaft, and wherein the scissors arms of the main panels are interconnected by a gear train so that the motor generally simultaneously controls motion of all of the scissors arms.

Still further in accordance with a preferred embodiment of the present invention the shaft slides generally along a longitudinal axis.

Additionally in accordance with a preferred embodiment of the present invention the cutting head is mounted on a base and connected to a motion device which moves the cutting head in at least one of a radial direction with respect to the shaft and a longitudinal direction along a length of the shaft, and wherein the motion device aligns the cutting head with the leg so that the cutting head can cut the leg in accordance with instructions from the controller.

In accordance with a preferred embodiment of the present invention there is provided finishing apparatus which is in electrical communication with the controller, wherein the finishing apparatus is mounted on a base and connected to a motion device which moves the finishing apparatus in at least one of a radial direction with respect to the shaft and a longitudinal direction along a length of the shaft, and wherein the motion device aligns the finishing apparatus with the leg so that the finishing apparatus can perform a finishing operation on the leg in accordance with instructions from the controller.

Further in accordance with a preferred embodiment of the present invention there are two such motion apparatus each of which independently imparts movement in a radial direction with respect to the shaft.

Still further in accordance with a preferred embodiment of the present invention the sewing head includes a drive mechanism operatively coupled to a bobbin assembly, characterized by a clutch which selectively couples the drive mechanism to the bobbin assembly.

There is also provided in accordance with a preferred embodiment of the present invention a method for altering length of trousers, including inputting customer-dictated parameters for altering a leg of a pair of pre-manufactured trousers into an input device of a trousers-altering apparatus, the parameters including at least a desired length of the leg, and cutting the trousers to the desired length.

In accordance with a preferred embodiment of the present invention the method also includes performing a finishing operation on the cut trousers. The performing preferably includes inputting a position of a fold line for forming a hem and inputting sewing instructions into the input device, folding the trousers to form the hem, and sewing the hem according to the sewing instructions.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
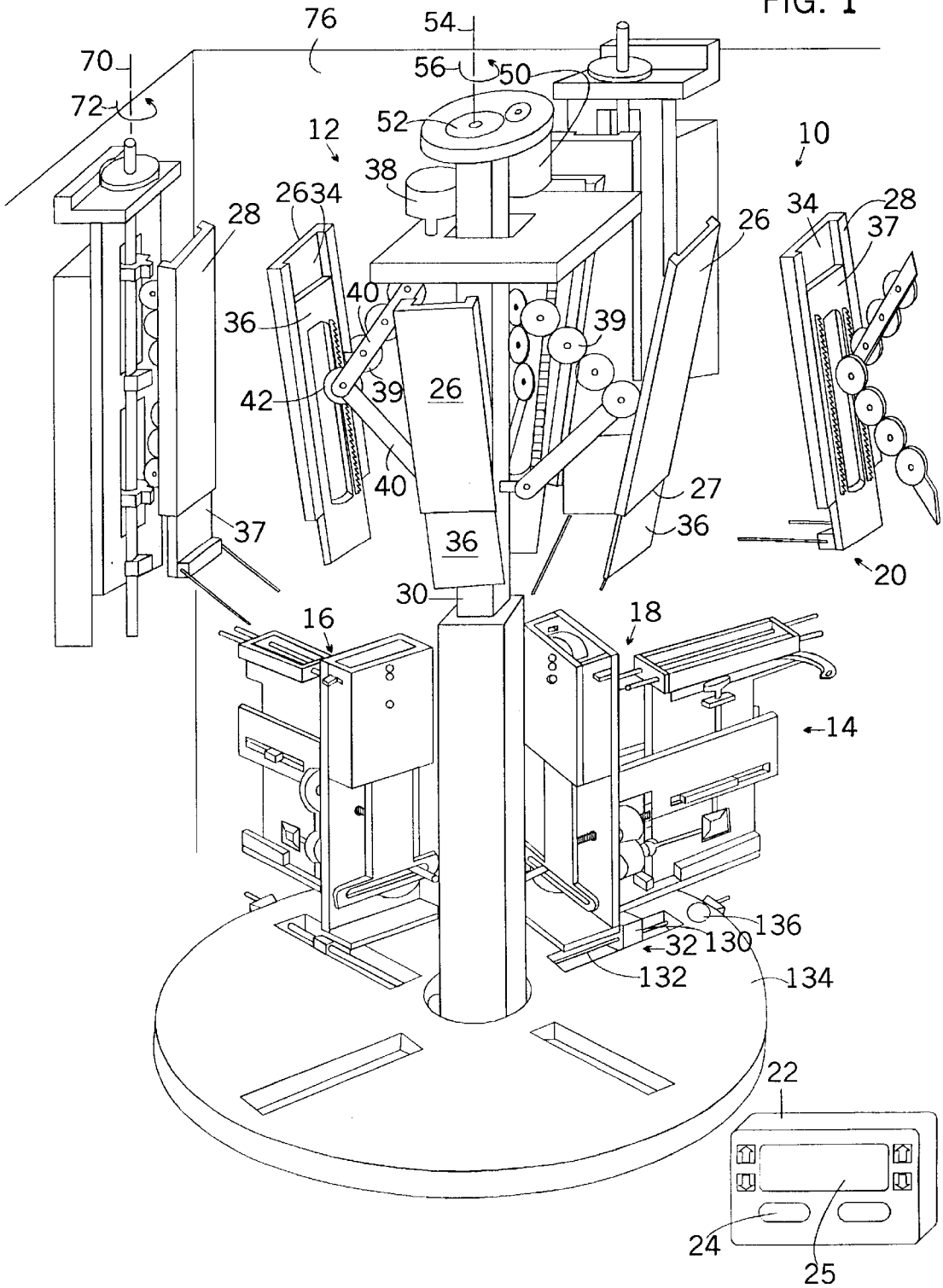
FIG. 1 is a simplified pictorial illustration of apparatus for altering length of trousers, constructed and operative in accordance with a preferred embodiment of the present invention.

Reference is now made to FIG. 1 which illustrates apparatus 10 for altering length of trousers, constructed and operative in accordance with a preferred embodiment of the present invention. Apparatus 10 preferably includes three main assemblies: a trousers gripping device 12 for fixedly holding a leg of a pair of trousers; finishing apparatus 14 comprising a cutting head 16 which cuts the leg of the trousers to a desired length, and one or more sewing heads 18 which sew the leg of the trousers, after cutting thereof; and a folding mechanism 20 for folding the leg of the trousers to form a hem. All three main assemblies, namely, trousers gripping device 12, finishing apparatus 14 and folding mechanism 20 are in electrical communication with a controller 22 which includes an input device 24, such as a keyboard, touch panel, voice data input device or the like, for inputting customer-dictated parameters for altering the leg of the trousers after manufacture thereof Controller 22 may also include a display monitor 25. It is noted that throughout the specification and claims the term "electrical communication" encompasses wired and wireless communication. Controller 22 may be mounted on a housing 76 of apparatus 10, or alternatively, may be hand-held.

In order to facilitate understanding of the present invention, first a brief, basic overview of the operation of apparatus 10 will be presented, followed afterwards by a detailed description of each main assembly. A customer wishing to purchase a pair of trousers tries them on in a store, and a salesperson marks the correct length and position of the hem of the trousers leg. The customer dictates what type of hem he/she desires, such as the size and number of folds, as well as any special sewing instructions if necessary, such as color of thread or type of stitch, these being only some of the possible examples of what is herein referred to collectively as customer-dictated parameters. The salesperson inputs the customer-dictated parameters into controller 22 by means of input device 24. Preferably controller 22 preserves the previously input parameters, so that one need not change them every time if not necessary.

One of the legs of the trousers is placed around a set of tightening panels 26 of trousers gripping device 12. A user may hold the upper portion of the trousers above trousers gripping device 12 and/or housing 76. However, preferably a holder (not shown) is provided for holding the upper portion of the trousers, so as to free the user's hands from having to hold the trousers during alteration thereof The mark designating the length and placement of the hem of the trousers leg is aligned with a bottom edge or protrusion 27 of panels 26. Panels 26 are then moved radially outwards to make the trousers leg taut. The whole trousers gripping device 12 may be first raised on a shaft 30 to facilitate placement of the trousers thereon. In such a case, after panels 26 have made the trousers leg taut, trousers gripping device 12 is lowered to its original position. A detailed description of trousers gripping device 12 is disclosed hereinbelow with reference to FIGS. 1–4. A secondary panel 36 which slides relative to panels 26, as described hereinbelow, is slid so that its bottom edge is poised for cutting thereat.

Cutting head 16 and sewing heads 18 of finishing apparatus 14 are then moved by a motion device 32 and brought into grabbing alignment with the trousers leg. A detailed description of cutting head 16 and sewing heads 18 is disclosed hereinbelow with reference to FIGS. 5–8. With the trousers leg held taut by panels 26, cutting head 16 cuts the leg to the desired length and the cut material is discarded.

The secondary panels 36 are then moved to correspond to a fold line, as determined by controller 22 in accordance with the customer-dictated parameters. A second set of clamping panels 28 is provided with a set of secondary panels 37. Panels 37, which comprise the folding mechanism 20, are slid in panels 28 to the level of the fold line. In order to prepare the trousers leg for hemming, cutting head 16 and sewing heads 18 are lowered somewhat so as not to interfere with the ensuing folding process, and panels 28 are brought radially inwards to clamp the trousers leg between panels 26 and 28. Folding mechanism 20 then folds the trimmed leg inward to form the hem, a detailed description of folding mechanism 20 being disclosed hereinbelow with reference to FIG. 3. More than one fold may be executed. Sewing heads 18 are raised again to sew the hem. The leg is then released from panels 26 and 28 of trousers gripping device 12, and the process repeated for the other leg. All operations are controlled by commands from controller 22 in accordance with instructions derived from the customer-dictated parameters.

Reference is now made to FIGS. 1 and 2A–2C which illustrate trousers gripping device 12 in accordance with a preferred embodiment of the present invention. Most preferably, as seen in FIG. 1, trousers gripping device 12 includes four pairs of tightening panels 26 arranged generally symmetrically about shaft 30, for the purposes of explanation, at positions corresponding to 0°, 90°, 180° and 270°. Shaft 30 may be moved upwards and downwards generally along a longitudinal axis 54, such as by means of a gear motor or pneumatic device (not shown) which telescopically moves shaft 30, so that trousers gripping device 12 can be raised above housing 76 in order to facilitate placement of the trousers thereon.

Panels 26 each have a channel 34 which receives therein a secondary panel 36 operatively connected to an actuator 38, such as a motor, solenoid, linear actuator or the like, which is in electrical communication with controller 22. Actuator 38 moves secondary panel 36 in channel 34 such that panel 36 selectively protrudes from panel 26 in accordance with instructions received from controller 22.

Figure 2C:
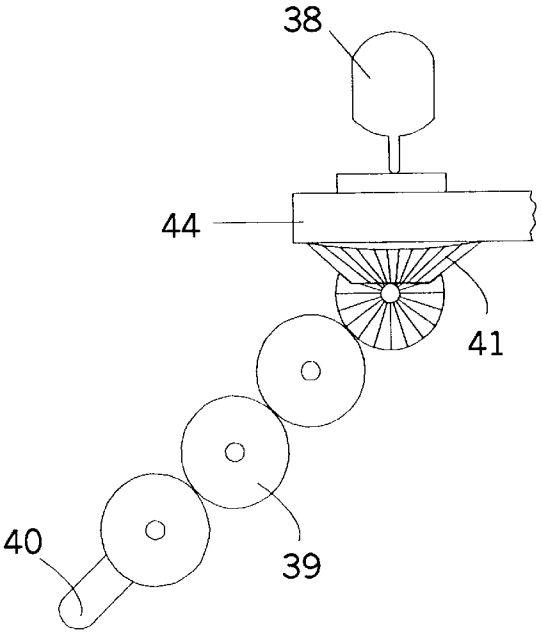
FIGS. 2B and 2C are simplified side view illustrations of a portion of the trousers gripping device, as viewed along arrows 2B and 2C, respectively, in FIG. 2A.
Figure 2B:
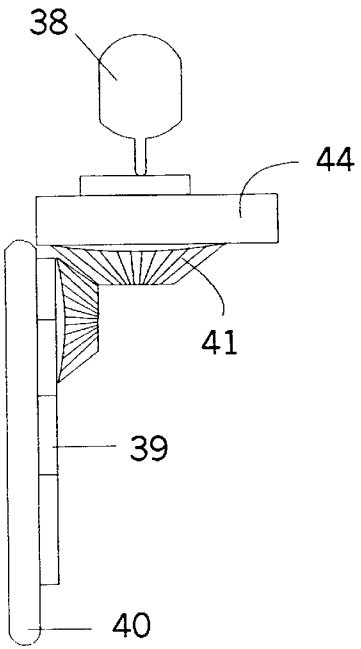
Figure 2A:
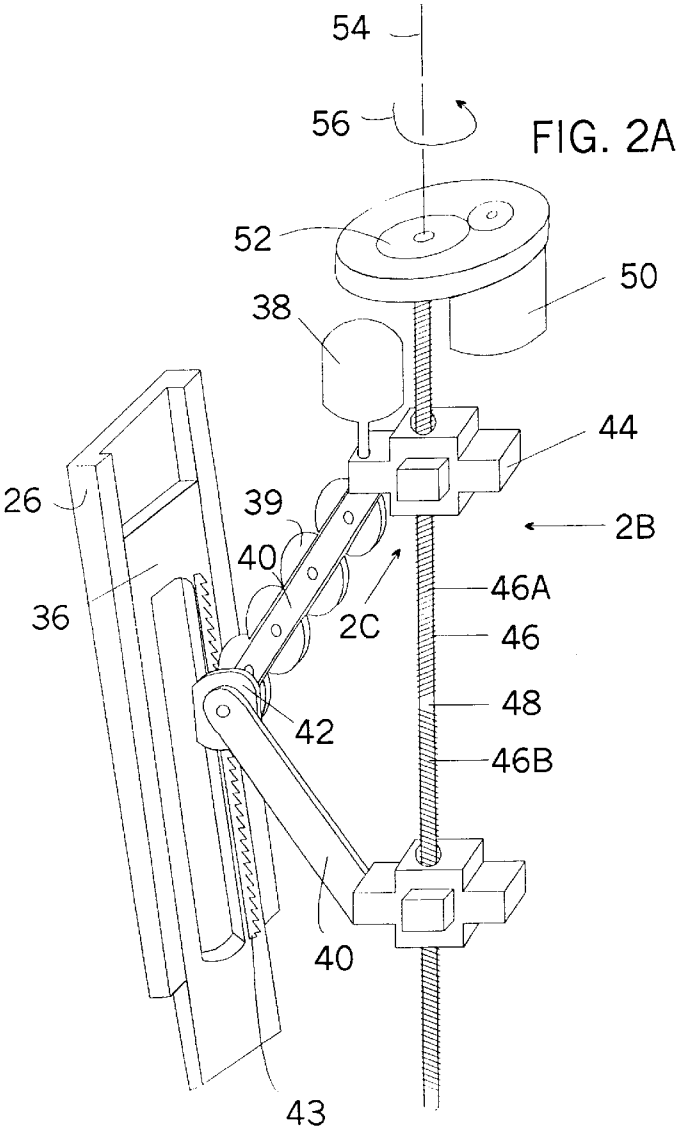
FIG. 2A is a simplified illustration of a trousers gripping device of the apparatus of FIG. 1, constructed and operative in accordance with a preferred embodiment of the present invention.

In the embodiment illustrated in FIGS. 2A–2C, which is only example of the type of actuation possible, actuator 38 rotates a bevel gear 41 which meshes with a gear train 39 which in turn meshes with a toothed rack 43 fixedly attached to secondary panel 36. Rotation of actuator 38 thus causes up and down sliding motion of secondary panel 36. It is appreciated by those skilled in the art that any other type of linkage from actuator 38 to secondary panel 36, such as a timing belt, can also be used.

A pair of scissors arms 40 is used to move panels 26 radially relative to shaft 30. Each arm 40 is pivotally connected at an end 42 thereof to panel 26, and is threadedly attached at an opposite end 44 thereof to a threaded rod 46. The gear train 39 is preferably mounted on the upper scissors arm, while the lower scissors arm is preferably bare. As seen in FIG. 2A, one portion 46A of rod 46 has a right-handed thread and is connected to one of scissors arms 40, while another portion 46B of rod 46 has a left-handed thread and is connected to another one of scissors arms 40. Right-handed threaded portion 46A adjoins left-handed threaded portion 46B at a central portion 48 of rod 46.

Referring to FIGS. 1 and 2A, a gear motor 50 is provided which imparts rotation to rod 46 through a gear 52 assembled at an end of rod 46. Rotation of rod 46 about a longitudinal axis 54 in a first direction shown by an arrow 56 causes both scissors arms 40 to advance towards each other, i.e., towards central portion 48, thereby at the same time causing panel 26 to move generally linearly and radially away from rod 46. Rotation in a second direction, opposite to the first direction of arrow 56, causes both scissors arms 40 to advance away from each other, i.e., away from central portion 48, thereby at the same time causing panel 26 to move generally radially and linearly towards rod 46.

Figure 3:
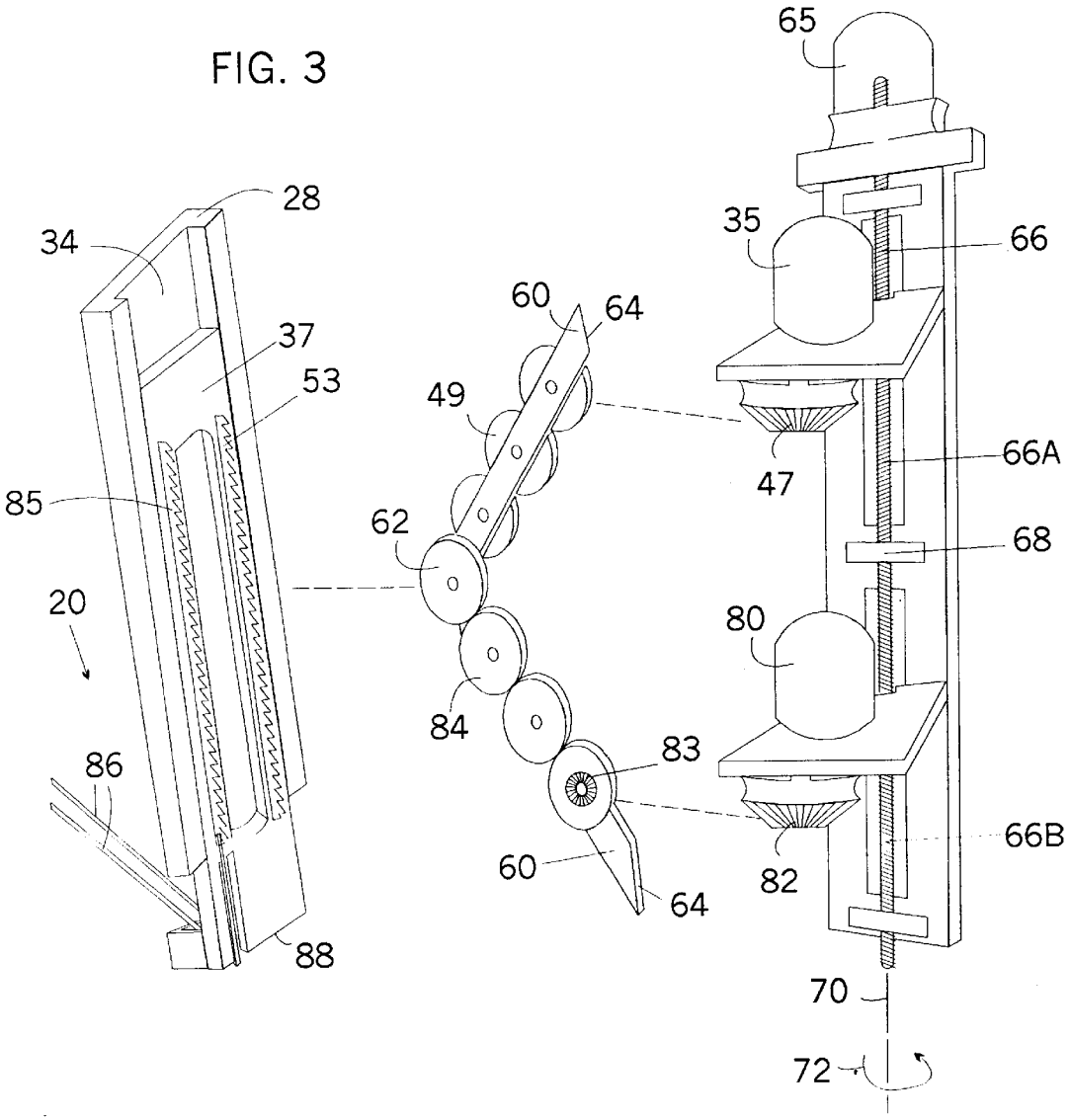
FIG. 3 is a simplified illustration of a trousers clamping device and folding mechanism of the apparatus of FIG. 1, constructed and operative in accordance with a preferred embodiment of the present invention.

Reference is now made to FIGS. 1 and 3 which illustrate folding mechanism 20. A plurality of pairs of clamping panels 28 are provided which operate in a similar manner to that described hereinabove for panels 26. In the illustrated embodiment of FIG. 1, four pairs of clamping panels 28 are arranged generally symmetrically about shaft 30, at positions corresponding to 0°, 90°, 180° and 270°, i.e., substantially aligned with panels 26. A pair of scissors arms 60 is used to move panels 28. Each arm 60 is pivotally connected at an end 62 thereof to panel 28, and is threadedly attached at an opposite end 64 thereof to a threaded rod 66 in the same manner as described hereinabove for arms 40 and rod 46 with reference to FIGS. 2A–2C.

It is noted that for the purposes of clarity and space on the drawing sheet, the right-side clamping panel 28 is not shown with its threaded rod 66 and the panel 28 closest to the viewer of the drawing sheet is not shown.

One portion 66A of rod 66 has a right-handed thread and is connected to one of scissors arms 60, while another portion 66B of rod 66 has a left-handed thread and is connected to another one of scissors arms 60. Right-handed threaded portion 66A adjoins lefthanded threaded portion 66B at a central portion 68 of rod 66. A gear motor 65 imparts rotation to rod 66. Rotation of rod 66 about a longitudinal axis 70 in a first direction shown by an arrow 72 causes both scissors arms 60 to advance towards each other, i.e., towards central portion 68, thereby at the same time causing panel 28 to move generally linearly and radially away from rod 66. Rotation in a second direction, opposite to the first direction of arrow 72, causes both scissors arms 60 to advance away from each other, i.e., away from central portion 68, thereby at the same time causing panel 28 to move generally radially and linearly towards rod 66.

By virtue of arms 40 and 60 being pivotally connected to panels 26 and 28, respectively, panels 26 and 28 can either be vertical or freely pivot about the vertical, typically, but not necessarily, in a range of ±45°. This is an important feature of the present invention because it allows the panels 26 and 28 to align themselves with any shape or contour of the bottom of the trousers leg, and to maintain the trousers leg taut when extended away from rods 46 and 66, respectively.

Panels 28 each have a channel 34 which receives therein a secondary panel 37 operatively connected to an actuator 35, such as a motor, solenoid, linear actuator or the like, which is in electrical communication with controller 22. Actuator 35 moves secondary panel 37 in channel 34 such that panel 37 selectively protrudes from panel 28 in accordance with instructions received from controller 22.

In the embodiment illustrated in FIG. 3, which is only example of the type of actuation possible, actuator 35 rotates a bevel gear 47 which meshes with a gear train 49 which in turn meshes with a toothed rack 53 fixedly attached to secondary panel 37. Rotation of actuator 35 thus causes up and down sliding motion of secondary panel 37. Gear train 49 is preferably mounted on the upper scissors arm 60.

Another actuator 80 rotates a bevel gear 82 which meshes with a gear train 84 which in turn meshes (such as by means of a bevel gear 83) with a toothed rack 85 slidingly attached to secondary panel 37. Gear train 84 is preferably mounted on the lower scissors arm 60. Toothed rack 85 is coupled to one or more wires 86 pivotally attached to an end 88 of secondary panel 37. Up and down sliding movement of toothed rack 85 causes wires 86 to pivot about end 88. Actuator 80, bevel gear 82, gear train 84, secondary panel 37, toothed rack 85 and wires 86 comprise the folding mechanism 20.

It is noted that the term "wire" encompasses any protruding structure suitable for folding the cloth of the trousers leg, such as a wire, bar, rod, jaws or the like.

It is appreciated by those skilled in the art that any other type of linkage from actuator 35 to secondary panel 37, such as a timing belt, can also be used.

Figure 4:
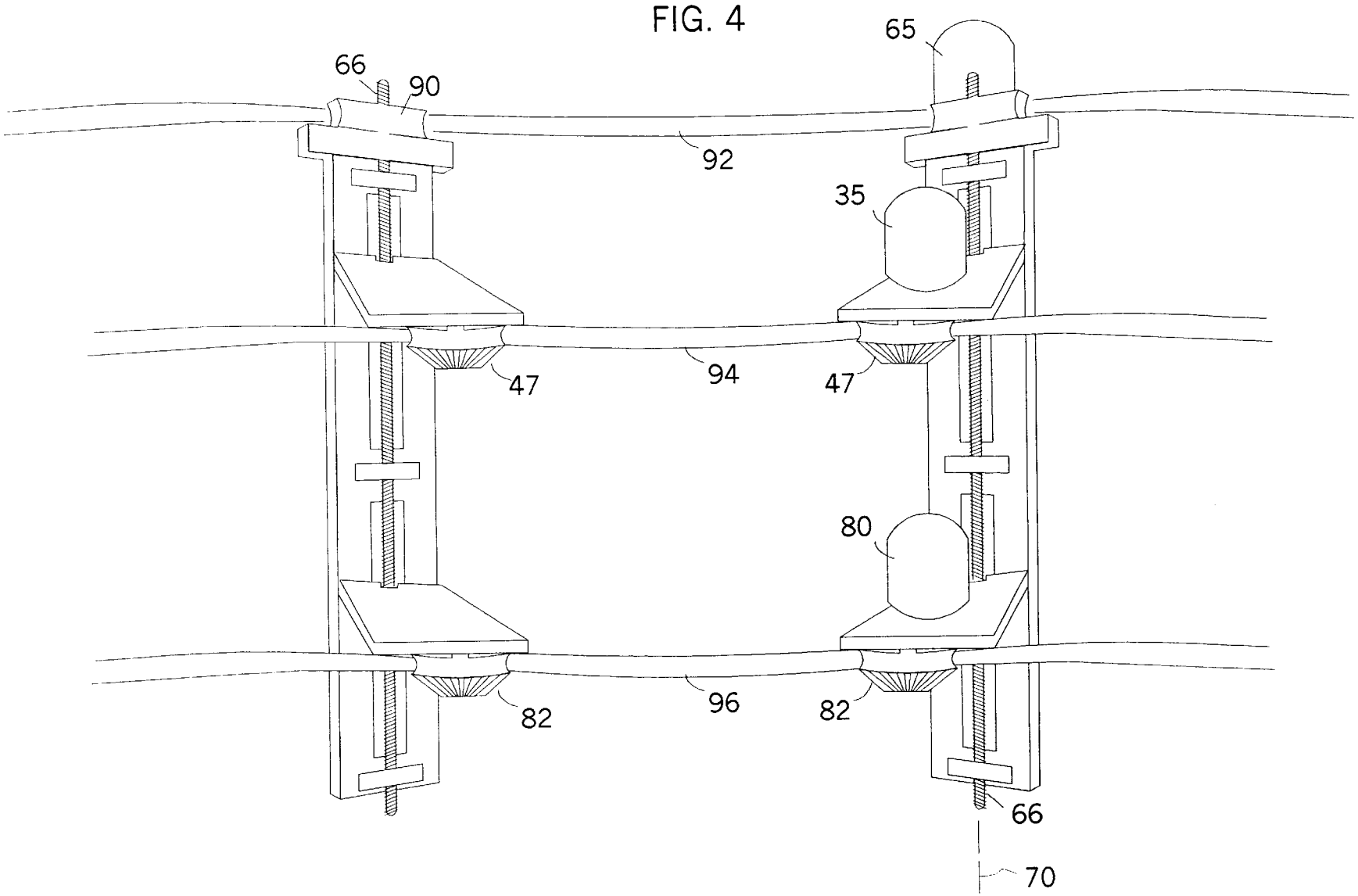
FIG. 4 is a simplified illustration of linking the trousers clamping devices and folding mechanisms of the apparatus of FIG. 1, in accordance with a preferred embodiment of the present invention.

Reference is now made to FIG. 4 which shows that in accordance with a preferred embodiment of the present invention, only one motor 65 need be employed. A pulley 90 may be mounted at a top end of rods 66 and a belt 92, or other similar linkage, links motor 65 to all rods 66. Thus the one motor 65 can impart synchronous rotation to all rods 66 simultaneously. Similarly, only one actuator 35 need be employed with a belt 94, or other similar linkage, linking all bevel gears 47. Belt 94 enables the one actuator 35 to impart synchronous sliding motion to all secondary panels 37 simultaneously. Similarly, only one actuator 80 need be employed with a belt 96, or other similar linkage, linking all bevel gears 82. Belt 96 enables the one actuator 80 to impart synchronous pivoting motion to all wires 86 simultaneously.

Figure 5:
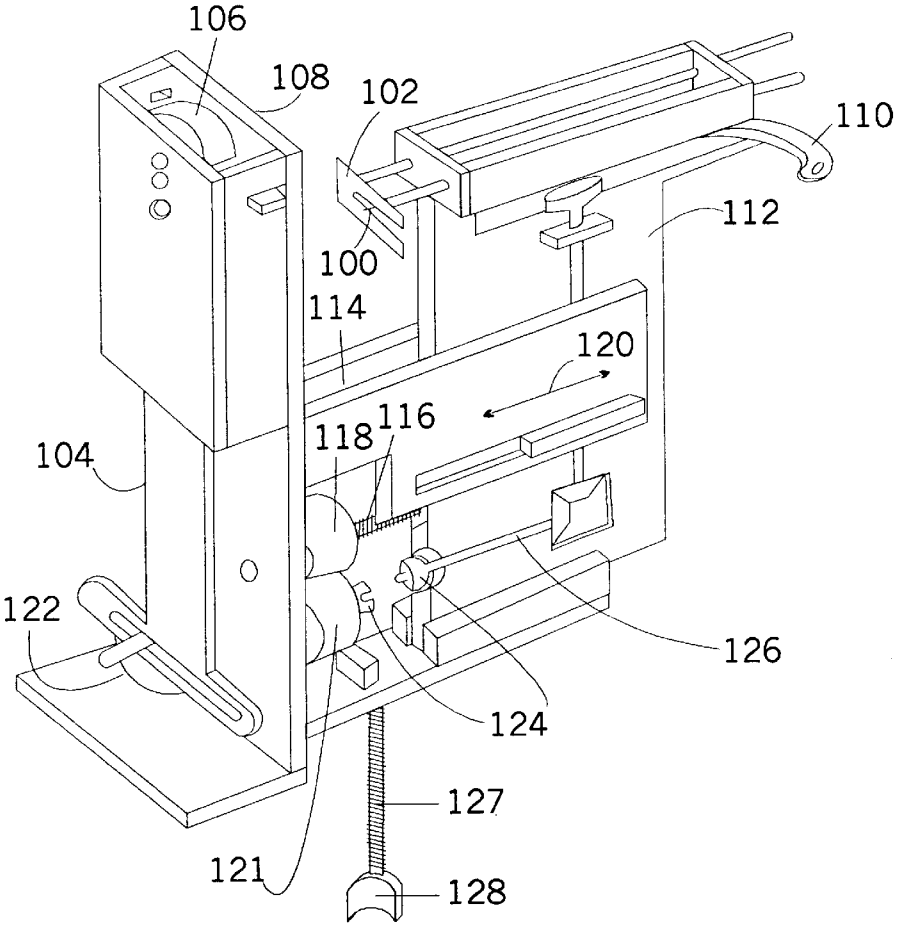
FIGS. 5 and 6 are simplified illustrations of a sewing head of the apparatus of FIG. 1, constructed and operative in accordance with a preferred embodiment of the present invention.
Figure 6:
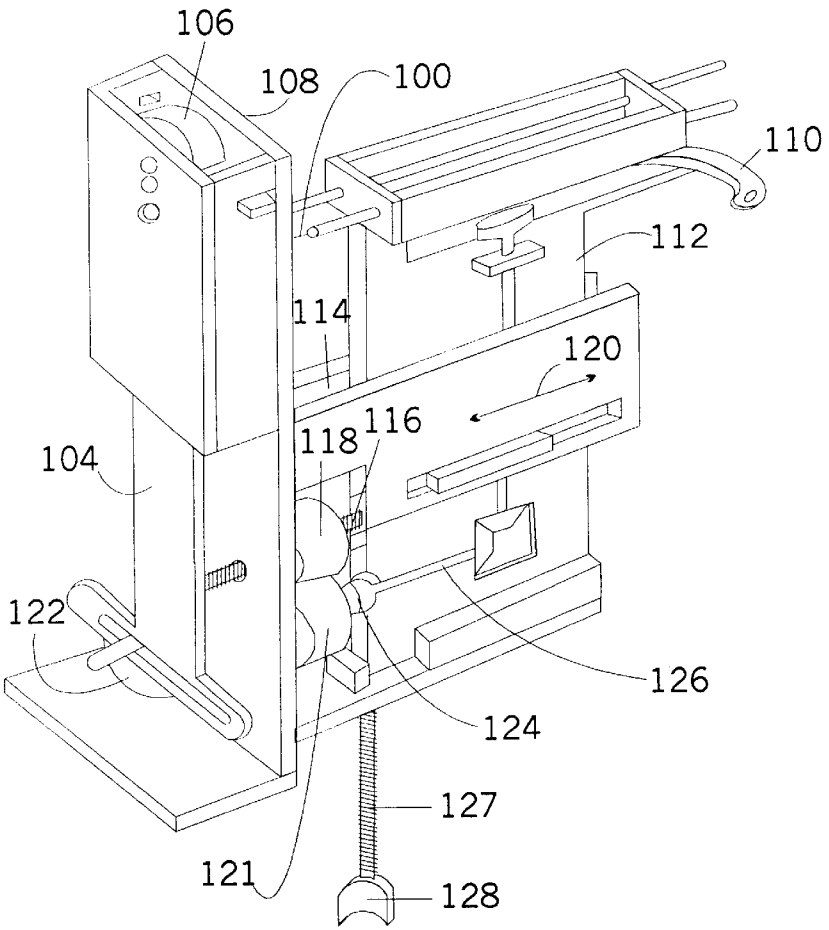

Reference is now made to FIGS. 5 and 6 which illustrate sewing head 18. Sewing head 18 preferably comprises any conventional sewing machine with certain rework. Sewing head 18, like any conventional sewing machine, includes a needle 100, a hinged presser foot 102, a slide plate 104, a bobbin 106, a flat bed 108, and a thread take-up lever 110, as well as a thread cutter (not shown) for cutting the thread after finishing sewing. Sewing head 18, however, differs from a conventional sewing machine in several respects:

First, needle 100 and hinged presser foot 102 are mounted on a sliding housing 112 which slides in a channel 114 and is mounted on a threaded rod 116 operatively connected to a motor 118. Motor 118 imparts rotation to rod 116 which causes housing 112 to slide generally in a direction indicated by an arrow 120, this direction being a radial direction with respect to shaft 30 of FIG. 1.

Second, a drive motor 121 is provided for providing the power for all of the sewing operations of sewing head 18, namely, driving needle 100, moving slide plate 104 via an eccentric drive 122, and feeding thread from bobbin 106. Drive motor 121 is coupled to all the above elements through a coupling 124 to a drive shaft 126. FIG. 5 illustrates drive motor 121 decoupled from drive shaft 126. When motor 118 slides housing 112 towards flat bed 108, coupling 124 couples drive motor 121 to drive shaft 126, as shown in FIG. 6, and sewing can commence.

Third, sewing head 18 is mounted on a threaded rod 127 which is rotated by a motor 128. Rotation of rod 127 imparts up and down motion to sewing head 18, which is along the length of shaft 30 (see FIG. 1). In addition, a motor mount 130 of motor 128 is itself mounted on a radially-directed, threaded shaft 132 in a base 134 of apparatus 10, as seen in FIG. 1. A motor 136 moves motor mount 130 and the rest of sewing head 18 along shaft 132.

Thus, motors 118 and 136 each independently move sewing head radially with respect to shaft 30. Motor 128 moves sewing head along the length of shaft 30. Together, motors, 118, 136 and 128 comprise the motion device 32.

Figure 7:
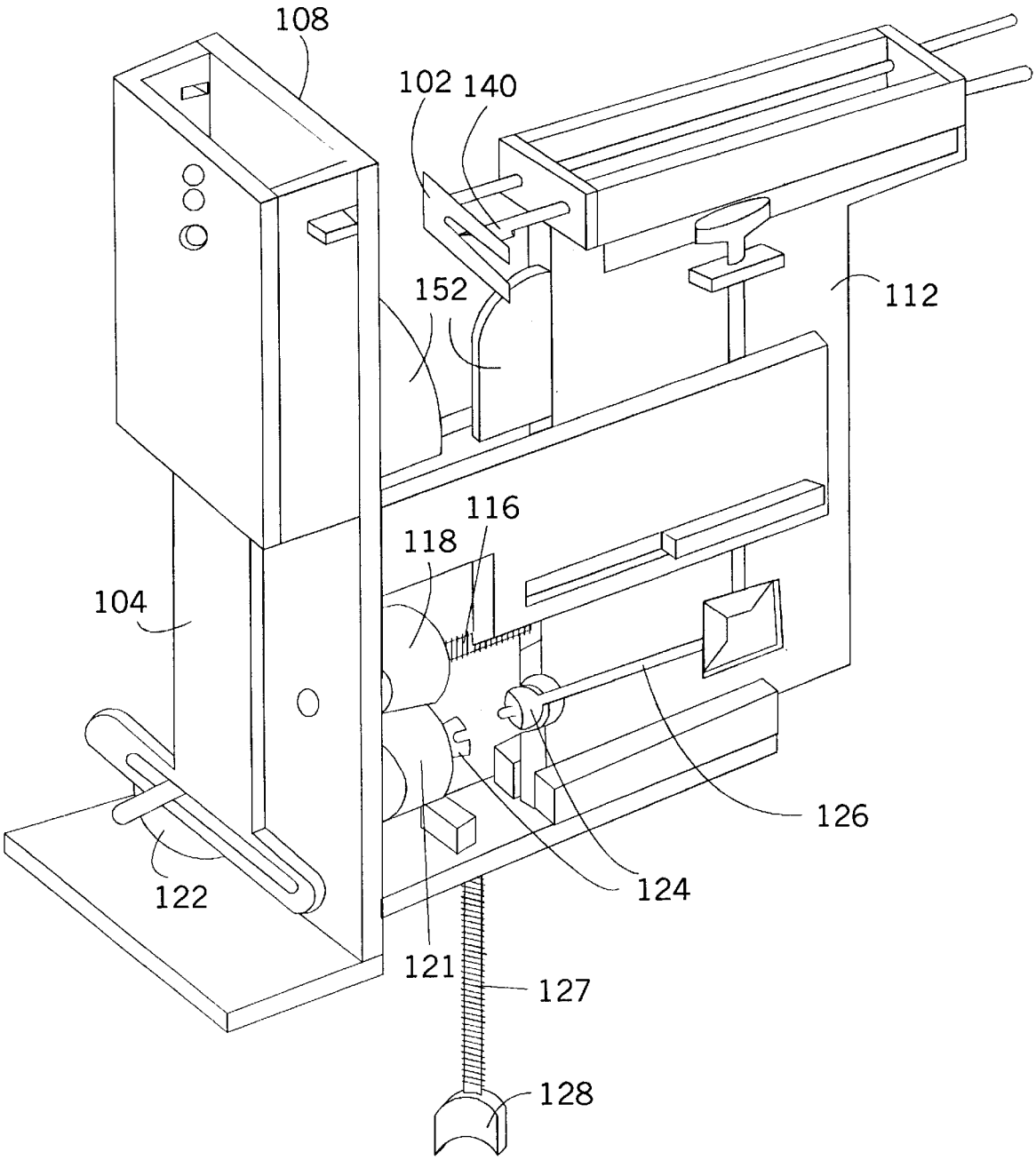
FIG. 7 is a simplified illustration of a cutting head of the apparatus of FIG. 1, constructed and operative in accordance with a preferred embodiment of the present invention.
Figure 8:
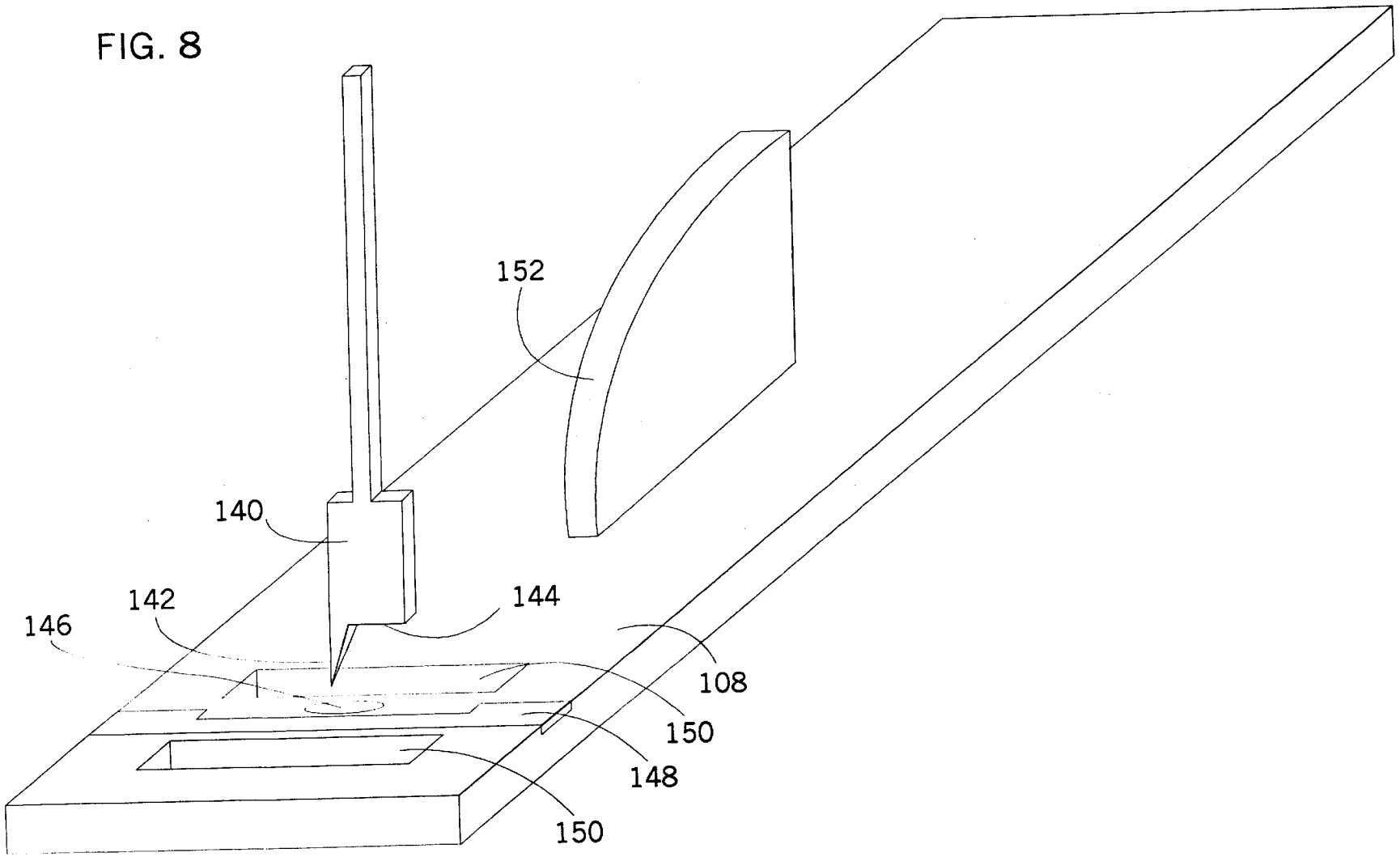
FIG. 8 is a simplified illustration of a portion of the cutting head of FIG. 7.

Reference is now made to FIGS. 7 and 8 which illustrate cutting head 16. Cutting head 16 basically has the same structure as sewing head 18, except that needle 100 is replaced by a cutter 140. As seen best in FIG. 8, cutter 140 preferably comprises a piercing point 142 extending from a knife-edge 144. Point 142 can pierce the cloth of the trouser leg and pass into a hole 146 formed in the top surface of flat bed 108. As point goes into hole 146, knife-edge 144 cuts the cloth against a razor member 148 which preferably protrudes slightly above the top surface of flat bed 108. Knife-edge 144 thus cuts the cloth by scissors-action in cooperation with razor member 148. The cutting action takes place in the vicinity of a pair of feed dog apertures 150 which receive therein feed dogs (not shown), the feed dogs being used for advancing the cloth as is known in the art.

After cutting the cloth, the cut cloth which is to be discarded may be severed completely and ejected from apparatus 10 by means of a pair of guillotine jaws 152. Motor 118 moves housing 112 so as to bring jaws 152 together to sever the cloth.

Reference is now again made to FIG. 1. Preferably one cutting head 16 and three sewing heads 18 are arranged generally symmetrically about shaft 30, at positions corresponding to 45°, 135°, 225° and 315°, i.e., generally between panels 26. For the sake of clarity, only one sewing head 18 is shown, but in FIG. 1 one can clearly see the remaining two threaded shafts 132 on which the remaining two sewing heads 18 are mounted for radial movement. As stated hereinabove in the short overview of the operation of apparatus 10, cutting head 16 and sewing heads 18 are moved by motion device 32 and brought into grabbing alignment with the trousers leg. "Grabbing alignment" is accomplished by moving hinged presser foot 102 towards flat bed 108 in order to press the cloth of the trousers leg against flat bed 108. Movement of sewing heads 18 and cutter head 16 is unobstructed by trousers grabbing device 12 by virtue of the staggered arrangement at 45°, 135°, 225° and 315°. Once sewing heads 18 and cutter head 16 grab the trousers leg, sewing or cutting can be performed.

Preferably base 134 rotates about shaft 30 by means of a suitable motion device, so that sewing heads 18 and cutting head 16 go around the trousers leg and trousers grabbing device 12 remains stationary. Alternatively, trousers grabbing device 12 can be made to rotate about shaft 30 and sewing heads 18 and cutter head 16 remain stationary.

With suitable modifications, folding mechanism 20 can be adapted to fold cuffs.

It is appreciated by persons skilled in the art that finishing apparatus 14 may alternatively or additionally include bonding apparatus (not shown) for applying adhesive to the bottom of the trousers leg for bonding the hem or cuff instead of or in addition to sewing same.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Apparatus for altering length of trousers, comprising:

a controller including an input device for inputting customer-dictated parameters for altering a leg of a pair of trousers after manufacture thereof; and a cutting head in electrical communication with said controller which receives said parameters and cuts said leg to a desired length in accordance with at least one of said parameters; and a trousers gripping device for fixedly holding said leg of the trousers to permit performing a trousers alteration operation on said leg, said trousers gripping device being in electrical communication with said controller.

2. Apparatus according to claim 1 and comprising at least one sewing head in electrical communication with said controller, said sewing head sewing said leg of said trousers, after cutting thereof, in accordance with instructions received from said controller.

3. Apparatus according to claim 1 and comprising a folding mechanism, in electrical communication with said controller, for folding said leg of said trousers in accordance with instructions received from said controller.

4. Apparatus according to claim 1 and wherein said trousers gripping device comprises a pair of main panels arranged for clamping said leg therebetween, each said main panel comprising a channel which receives therein a secondary panel, said secondary panel sliding in said channel and selectively protruding from said main panel in accordance with instructions received from said controller.

5. Apparatus according to claim 4 and wherein said secondary panel comprises a folding mechanism, in electrical communication with said controller, for folding said leg of said trousers in accordance with instructions received from said controller.

6. Apparatus according to claim 5 and wherein said folding mechanism comprises at least one wire pivotally attached to an end of said secondary panel, said at least one wire being arranged to swing against said leg, thereby to fold a portion of said leg about said end of said secondary panel.

7. Apparatus according to claim 4 and wherein each one of a pair of scissors arms is connected at one end thereof to each said main panel, each said scissors arm being threadedly attached at an opposite end thereof to a threaded rod, one portion of the rod having a right-handed thread and connected to one of the scissors arms and another portion of the rod having a left-handed thread and connected to the other one of the scissors arms, said right-handed threaded portion adjoining said left-handed threaded portion at a central portion, said rod being connected to a motor for rotation thereof, such that rotation in a first direction of said rod causes both said scissors arms to advance towards each other and towards said central portion, thereby at the same time causing said main panel to move generally radially and linearly away from said rod, and wherein rotation in a second direction, opposite to said first direction, of said rod causes both said scissors arms to advance away from each other and away from said central portion, thereby at the same time causing said main panel to move generally radially and linearly towards said rod.

8. Apparatus according to claim 4 and wherein said trousers gripping device comprises a plurality of said pairs of main panels arranged for clamping said leg therebetween, said plurality of pairs being generally symmetrically arranged about a shaft.

9. Apparatus according to claim 7 and wherein said trousers gripping device comprises a plurality of said pairs of main panels arranged for clamping said leg therebetween, said plurality of pairs being generally symmetrically arranged about a shaft, and wherein the scissors arms of the main panels are interconnected by a gear train so that said motor generally simultaneously controls motion of all of the scissors arms.

10. Apparatus according to claim 8 and wherein said shaft slides generally along a longitudinal axis.

11. Apparatus according to claim 8 and wherein said cutting head is mounted on a base and connected to a motion device which moves said cutting head in at least one of a radial direction with respect to said shaft and a longitudinal direction along a length of said shaft, and wherein said motion device aligns said cutting head with said leg so that said cutting head can cut said leg in accordance with instructions from said controller.

12. Apparatus according to claim 8 and comprising finishing apparatus which is in electrical communication with said controller, wherein said finishing apparatus is mounted on a base and connected to a motion device which moves said finishing apparatus in at least one of a radial direction with respect to said shaft and a longitudinal direction along a length of said shaft, and wherein said motion device aligns said finishing apparatus with said leg so that said finishing apparatus can perform a finishing operation on said leg in accordance with instructions from said controller.

13. Apparatus according to claim 12 and wherein said finishing apparatus comprises at least one sewing head.

14. Apparatus according to claim 12 and comprising two said motion apparatus each of which independently imparts movement in a radial direction with respect to said shaft.

15. Apparatus according to claim 13 and wherein said sewing head comprises a drive mechanism operatively coupled to a bobbin assembly, characterized by a clutch which selectively couples said drive mechanism to said bobbin assembly.

16. Apparatus for altering length of trousers, comprising:

a controller including an input device for inputting customer-dictated parameters for altering a leg of a pair of trousers after manufacture thereof;

a trousers gripping device for fixedly holding said leg of the trousers to permit performing a trousers alteration operation on said leg, said trousers gripping device being in electrical communication with said controller and being mounted on a shaft; and finishing apparatus in electrical communication with said controller, wherein said finishing apparatus is mounted on a base and connected to a motion device which moves said finishing apparatus in at least one of a radial direction with respect to said shaft and a longitudinal direction along a length of said shaft, and wherein said motion device aligns said finishing apparatus with said leg so that said finishing apparatus can perform a finishing operation on said leg in accordance with instructions from said controller.

17. Apparatus according to claim 16 and wherein said finishing apparatus comprises at least one cutting head.

18. Apparatus according to claim 16 and wherein said finishing apparatus comprises at least one sewing head.

* * * * *